US010183382B2

(12) United States Patent
Koval

(10) Patent No.: US 10,183,382 B2
(45) Date of Patent: Jan. 22, 2019

(54) STRAP WRENCH

(71) Applicant: Richard Edmund Koval, Elkhorn, WI (US)

(72) Inventor: Richard Edmund Koval, Elkhorn, WI (US)

( * ) Notice: Subject to any disclaimer, the term of this patent is extended or adjusted under 35 U.S.C. 154(b) by 232 days.

(21) Appl. No.: 15/406,735

(22) Filed: Jan. 15, 2017

(65) Prior Publication Data

US 2017/0252904 A1 Sep. 7, 2017

Related U.S. Application Data

(63) Continuation-in-part of application No. 29/586,359, filed on Dec. 2, 2016, now Pat. No. Des. 829,068.

(60) Provisional application No. 62/389,540, filed on Mar. 1, 2016.

(51) Int. Cl.
*B25B 13/52* (2006.01)
*B25B 27/00* (2006.01)

(52) U.S. Cl.
CPC ..... *B25B 13/52* (2013.01); *B25B 27/0042* (2013.01)

(58) Field of Classification Search
CPC ..... B25B 27/0042; B25B 13/52
See application file for complete search history.

(56) References Cited

U.S. PATENT DOCUMENTS 1,422,302 A 7/1922 Parker
2,995,965 A * 8/1961 Hockney ..... B25B 13/52 81/64
3,962,936 A * 6/1976 Lewis ..... B25B 13/52 81/64
4,145,938 A 3/1979 Laird, Jr.
4,221,140 A * 9/1980 Bracey ..... B25B 13/52 81/64
D268,164 S 3/1983 Sandberg
4,506,568 A * 3/1985 Aamodt ..... B25B 13/52 81/64
4,646,593 A * 3/1987 Robertson ..... B25B 13/52 81/3.43
4,750,389 A * 6/1988 Shuster ..... B25B 27/0042 81/3.43
6,089,126 A * 7/2000 Teeter ..... B25B 13/52 81/3.43
6,101,903 A 8/2000 Negley et al.
6,834,568 B2 12/2004 Khubani
7,040,198 B2 * 5/2006 Gelpi, Jr. ..... B25B 13/52 81/3.43
2006/0112792 A1 6/2006 Ping
2007/0089569 A1 4/2007 Hernandez, Jr.
(Continued)

OTHER PUBLICATIONS

Result of Google Search, Term:"Socket Strap Wrench", (Jan. 15, 2017) (date the items shown were disclosed to public unknonw).

*Primary Examiner* — David B Thomas
(74) *Attorney, Agent, or Firm* — Monty Simmons; Simmons Patents

(57) ABSTRACT

The present invention relates in general to the field of tools and in particular to an adjustable wrench apparatus particularly useful for turning items of nonstandard size such as oil filters, treaded pipes or other threaded and unthreaded items. The device comprises a core configured to receive a strap where such strap wraps around an item to be turned where the core is further configured to be activated by a typical tool such as a ratchet.

20 Claims, 11 Drawing Sheets

(56) References Cited

U.S. PATENT DOCUMENTS

| | | | | |
|---|---|---|---|---|
| 2008/0047398 | A1* | 2/2008 | Buchanan | B25B 13/52<br>81/65.4 |
| 2013/0298508 | A1 | 11/2013 | Metcalf | |

* cited by examiner

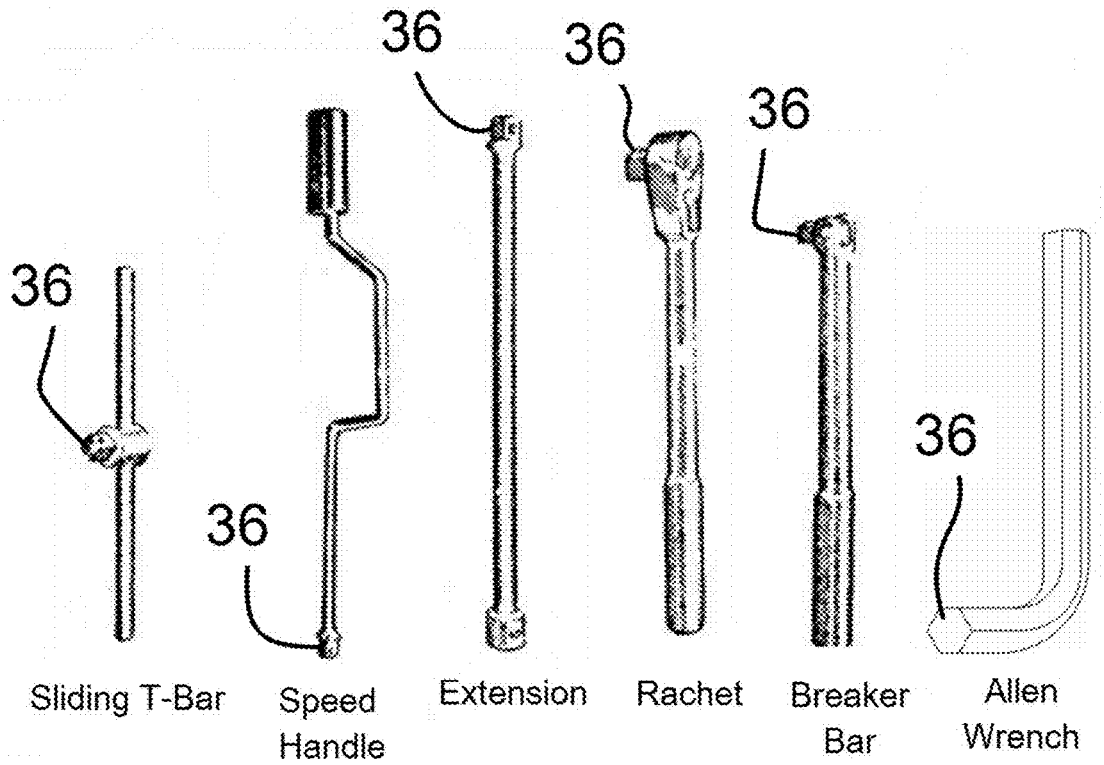
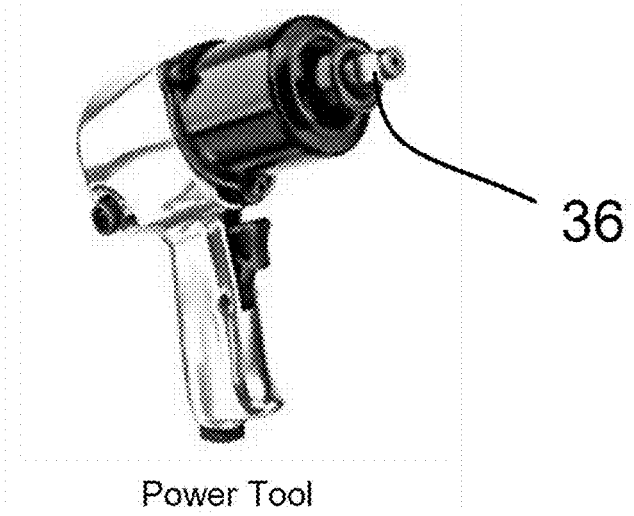
Fig. 10

STRAP WRENCH

CLAIM TO PRIORITY

This application claims priority to provisional application 62/389,540, filed on 1 Mar. 2016, and is a continuation in part to application Ser. No. 29/586,359, filed on 2 Dec. 2016, of which the entire contents are hereby incorporated by this reference for all that they disclose for all purposes.

TECHNICAL FIELD

Embodiments of the present invention relate in general to the field of tools and in particular to an adjustable wrench apparatus configured for loosing and tightening items such as oil filters, treaded pipes or other threaded and unthreaded items.

BACKGROUND OF THE INVENTION

When associating/assembling and disassembling two things together, there is a frequent need for a tool. A common method of mechanically associating two objects together is to have threads on both objects and generate a rotational force (torque) causing at least one of the objects to rotate so that the threads of the first object become associated with the threads of the second object. When rotated in a first direction, such objects move closer to each other (tighten) and when rotated in a second opposite direction such objects move away from each other (loosen). Such is well known in the art. Common tools used to create the rotational forces (motion) needed to tighten and loosen a threaded association are also well known and include wrenches and sockets for items such a nuts and bolts. Screw drivers use the same principles to insert and remove screws.

It is not uncommon for a first item thread to a second item to define non-standard shapes or configurations that are not easily manipulated using typical tools such as sockets or wrenches of set dimensions. For such situations one needs a tool that is adjustable to fit items of various ("odd") sizes.

A strap wrench is a tool that comprises a strap that wraps around an object and grips such object so that the strap (or chain, or other griping element) is pulled to create a tension around such object until such strap firmly grips the object thereby creating a static friction that keeps the strap from slipping thereby causing the object to rotate as the strap moves. Since it is a strap that is used to wrap around the item of interest, there are almost infinite size adjustment possibilities (i.e. diameters) between the minimum and maximum size limitations of a strap wrench.

The strap or chain can have various forms and can be made of any suitable materials such as webbing, nylon, leather, rubber, polymers, and even bands of spring steel that generally define a smooth, flexible, non-marring (for some configurations), high-friction strap. The drive component (used to generate the rotational forces) of many strap wrenches comprise built-in handles. Today's strap wrenches work well for their intended purposes, however, there are problems with such wrenches. More particularly, the drive components of prior art strap wrenches have issues. The inventions disclosed in this document addresses at least such issues.

SUMMARY OF THE INVENTION

Some of the objects and advantages of the invention will now be set forth in the following description, while other objects and advantages of the invention may be obvious from the description, or may be learned through practice of the invention.

Broadly speaking, a principle object of the present invention is to provide an apparatus and method for associating and disassociating two items where such apparatus and method provide almost infinitely variable sizes between a maximum and minimum size.

Another object of the present invention is to provide a tool for associating and disassociating two items wherein such tool comprises a body with three slots configured for adjustably receiving a clamping element that can be adjusted to fit a plurality of items defining a plurality of shapes and sizes.

Another object of the present invention is to provide a tool for associating and disassociating two items wherein such tool comprises a body with three slots configured for adjustably receiving a clamping element that can be adjusted to fit a plurality of items defining a plurality of shapes and sizes wherein such tool can be activated by a standard ratchet/socket wrench.

Additional objects and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which:

FIG. 10 shows several prior art tools defining a drive-element rotation-facilitator.

DISCLOSURE OF THE INVENTION

Detailed Description

Figure 0:
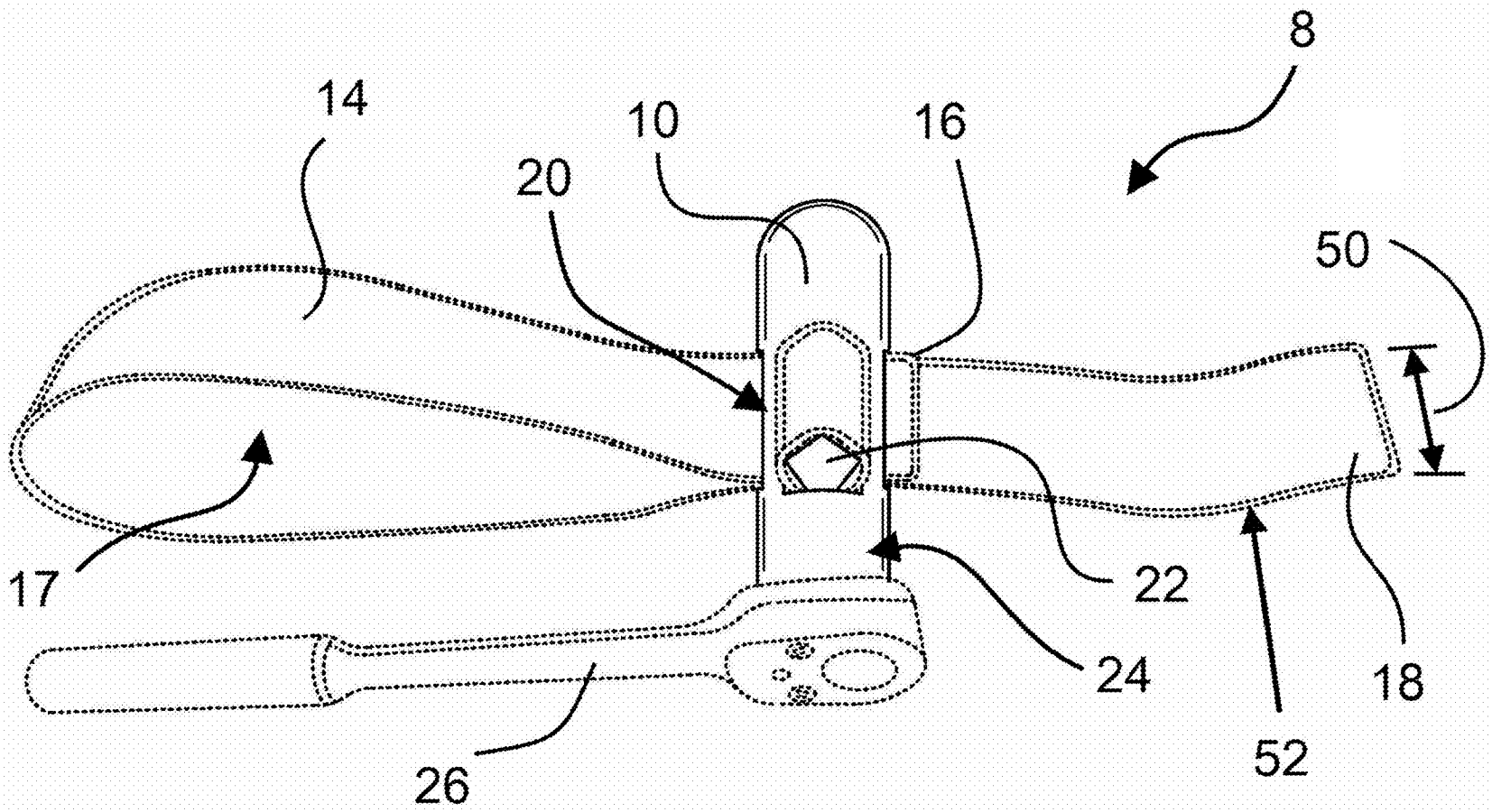
FIG. 0 is a side elevated perspective view of one exemplary embodiment of a strap wrench defining a loop (17) and showing a socket wrench (26) as the exemplary drive element.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

Construction Aids

For the purposes of this document two or more items are "mechanically associated" by bringing them together or into relationship with each other in any number of ways including a direct or indirect physical "releasable connections" (snaps, screws, Velcro®, bolts, etc.—generally connections designed to be easily and frequently released and reconnected), "hard-connections" (welds, rivets, macular bonds, generally connections that one does not anticipate disconnecting very often if at all and that generally needs to be "broken" to separate), and/or "moveable connections" (rotating, pivoting, oscillating, etc.).

For the purposes of this document, unless otherwise stated, the phrase "at least one of A, B, and C" means there is at least one of A, or at least one of B, or at least one of C or any combination thereof (not one of A, and one of B, and one of C).

This document includes headers that are used for place markers only. Such headers are not meant to affect the construction of this document, do not in any way relate to the meaning of this document nor should such headers be used for such purposes.

While the particulars of the disclosed inventions and associated technology may be described as a tool using a strap, the inventions may be adapted for use with any type of clasping component for grasping items.

DESCRIPTION

Figure 1:
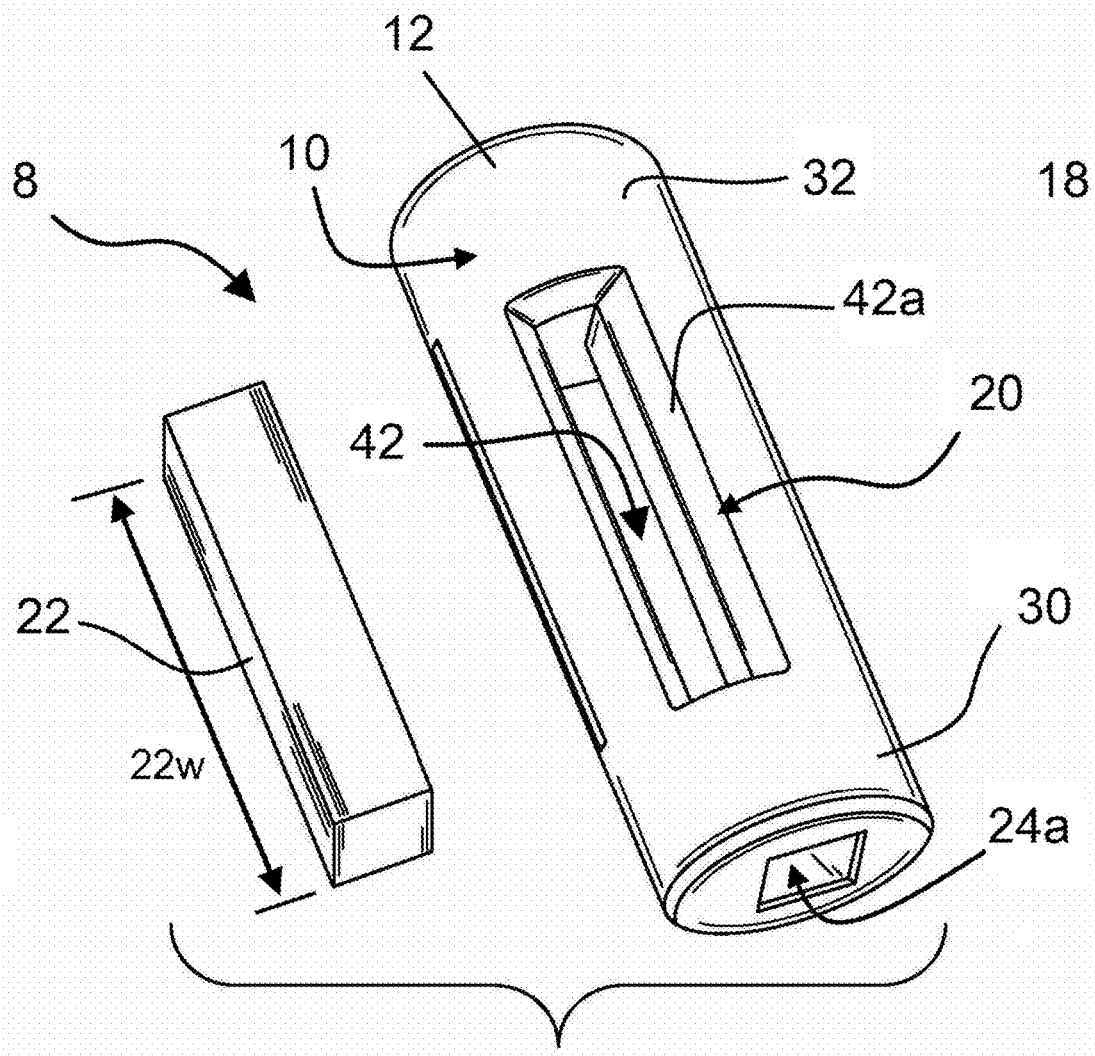
FIG. 1 is an elevated perspective view of one exemplary embodiment of a strap wrench body and clamping element.

Referring now to FIG. 0 and FIG. 1, elevated perspective views of a strap wrench and strap wrench components are considered. For one exemplary embodiment, a strap wrench system (8) comprises a body (core) (10) configured to receive a clasping element (14). The Clasping element (14) defines a first-clasping-element-end (16) and an opposing second-clasping-element-end (18). The first-clasping-element-end (16) is configured to pass through a passage that extends through body (10), create a loop (17) and pass back into such passage and then pass through a cradle portion (20) and wraparound a cradle element (22) and pass back into the cradle portion (20) and back out the passage toward the opposing second end (18).

Figure 9:
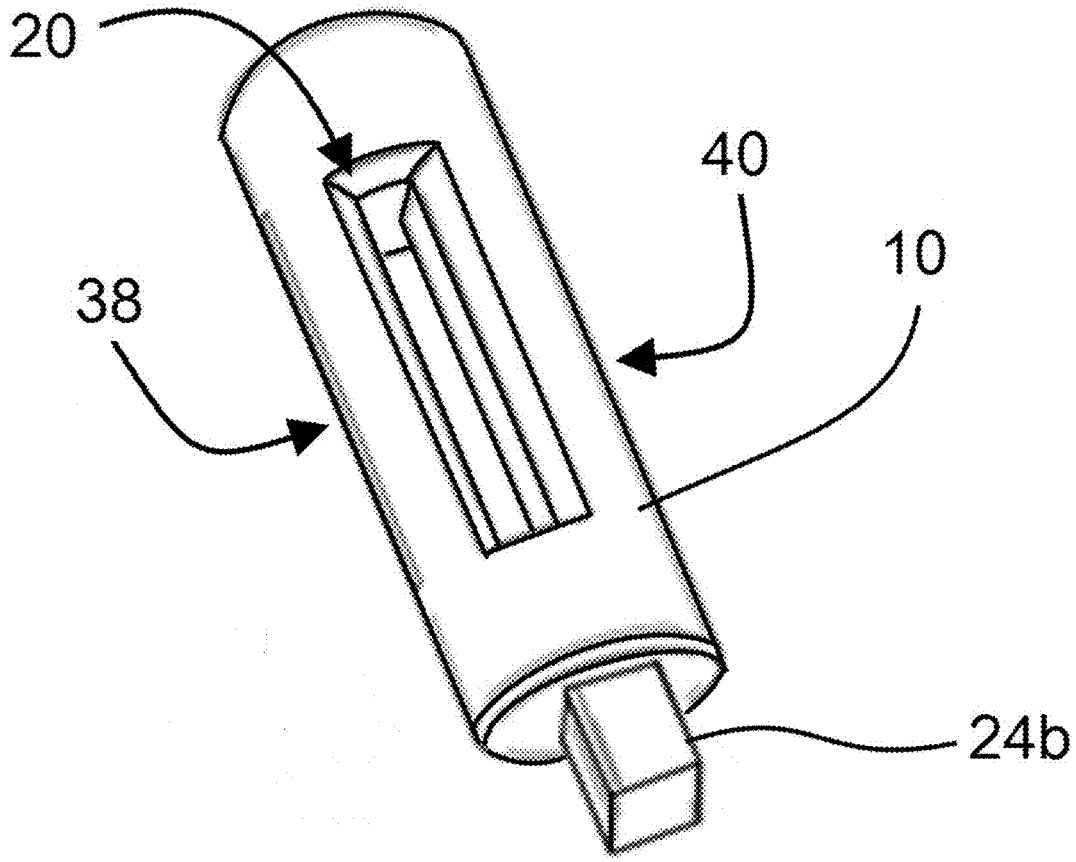
FIG. 9 is an elevated perspective view of one alternative embodiment of a strap wrench defining a stud-extension.
Figure 11:
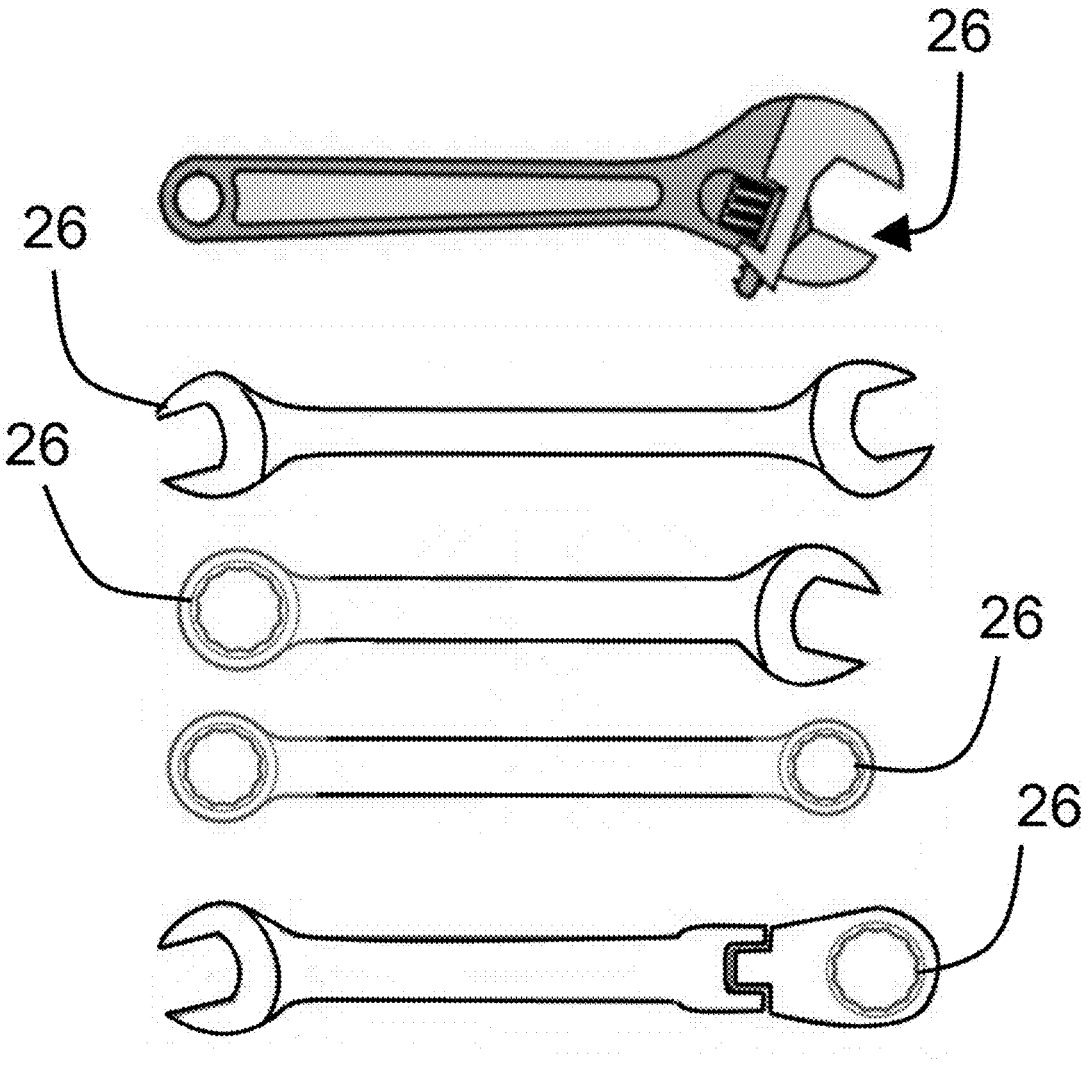
FIG. 11 shows several prior art tools defining a rotation-facilitator.

The body (10) defines a first end (30) and a second end (32). At least one end of the body (10) defines a drive portion (24) that is one of (a) configured with an integral rotation-facilitator (26) and/or (b) configured to receive a rotation-facilitator (26). As depicted in FIG. 0, the rotation-facilitator (26) is a prior art socket wrench (FIG. 10 and FIG. 11) that is mechanically associated with the drive-void (24*a*) defined by drive portion (24). Thus, drive portion (24) is preferably configured to receive the drive-element of a rotation-facilitator via a drive-void (24*a*, FIG. 1), or a stud-extension (24*b*, FIG. 9), or the drive portion may define an integral rotation-facilitator. Examples of suitable rotation-facilitators include a socket wrench, a speeder handle, a spanner wrench, a sliding T-handle, a hinge handle, a breaker bar, an Allen wrench, stud-extension, a socket, a wrench, a ratcheting box wrench, an adjustable wrench, and a power tool (FIG. 10, FIG. 11).

One of ordinary skill in the art will appreciate that when one makes a loop (17) around an item (such as an oil filter) and pulls the second-clasping-element-end (18) so that the loop is snug around the item, and then activates the rotation-facilitator (26), the body (10) will rotate causing the loop (17) to tighten around the item further and will eventually cause such item to rotate. For the exemplary embodiment depicted in FIG. 0, when socket wrench (26) is activated (cranked back and forth) the body (10) will rotate along with the drive-element of the socket wrench. Further, when body (10) defines a drive portion at both the first end (30) and second end (32), changing the direction of rotation of body (10) is as simple as moving the rotation-facilitator (26) from one end to the other (as one example).

As best seen in FIG. 1 through FIG. 9, the body/core (10) is examined in more detail. As previously described, the Core (10) is configured for receiving a clasping element (14) that is suitable for clasping an object (such as an oil filter, not shown) to rotate such object to either remove (unscrew) or install (screw on) such object. For the currently preferred embodiment, core (10) defines an elongated body (12) having an outer perimeter (28, FIG. 8) defining an outer surface. While the outer perimeter (28) for the currently preferred embodiment defines a circle, it will be appreciated that the outer perimeter (28) may define any polygonal shape without departing from the scope and spirit of the invention.

The elongated body further defines a first end (30) and an opposing second end (32). For such currently preferred embodiment, the body further defines an inner void (34, FIG. 8) running at least partially between the first end (30) and the second end (32). At least one of the first end (30) and the second end (32) define a drive portion (24) configured to facilitate rotation of said elongated body. As depicted in FIG. 1, for the current embodiment, the drive portion (24) defines a drive-void (24*a*) configured to receive the drive element (36, FIG. 10) of a rotation-facilitator such as a socket wrench, a speeder handle, a spanner wrench, a sliding T-handle, a hinge handle, a breaker bar, an Allen wrench and a power tool.

Figure 2:
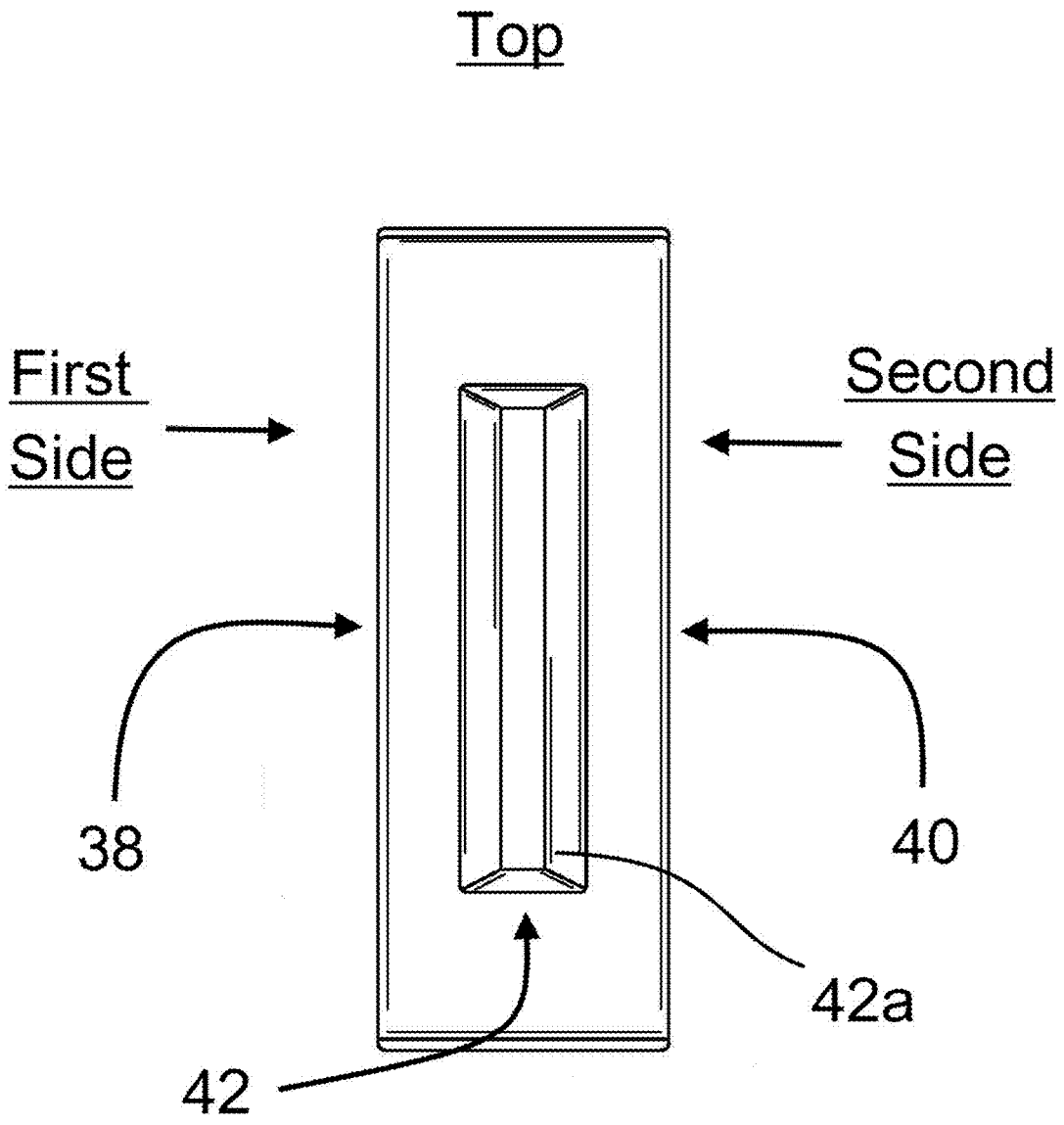
FIG. 2 is a top plan view of the strap wrench depicted in FIG. 1.
Figure 3:
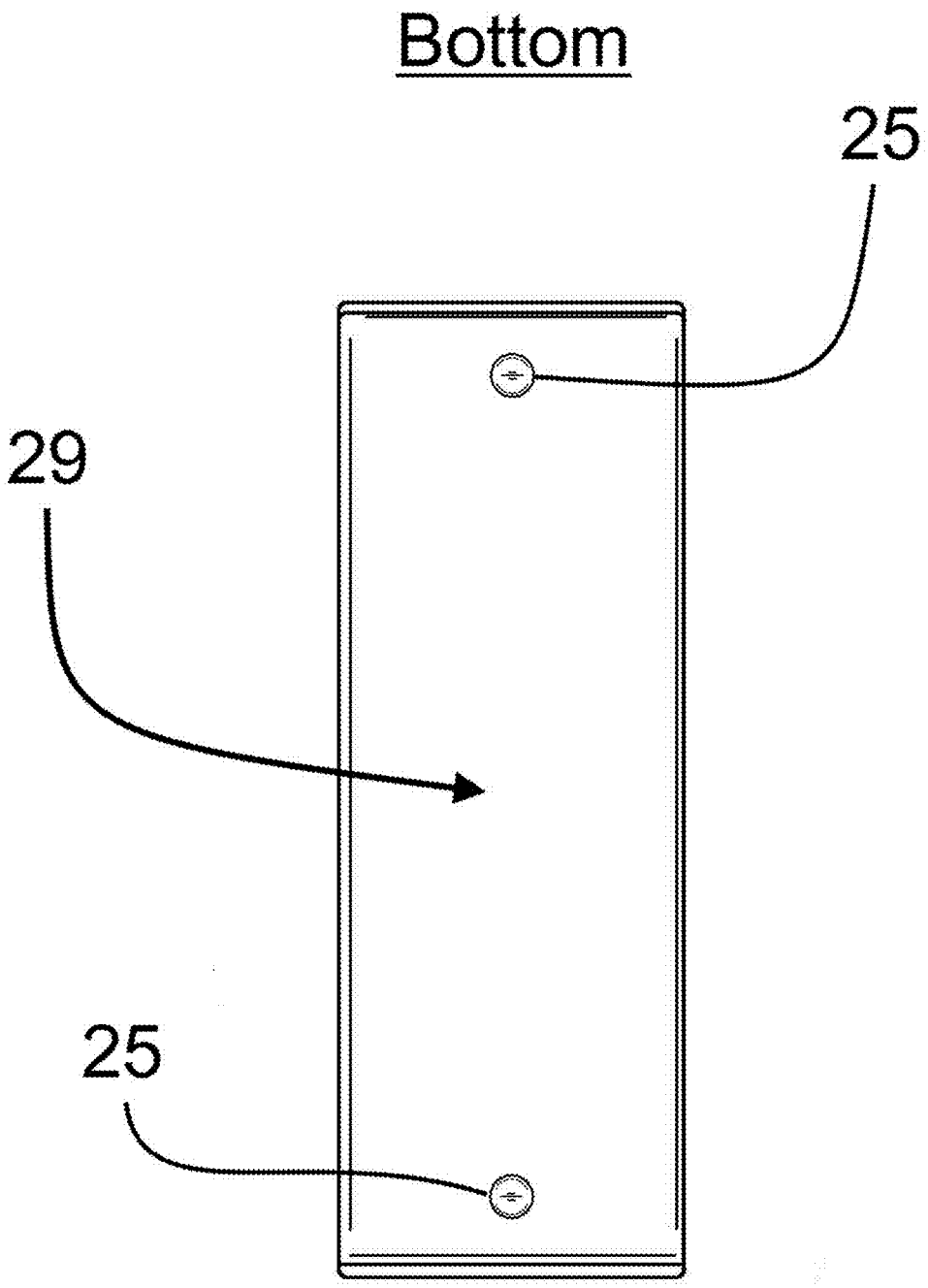
FIG. 3 is a bottom plan view the strap wrench depicted in FIG. 1.
Figure 4:
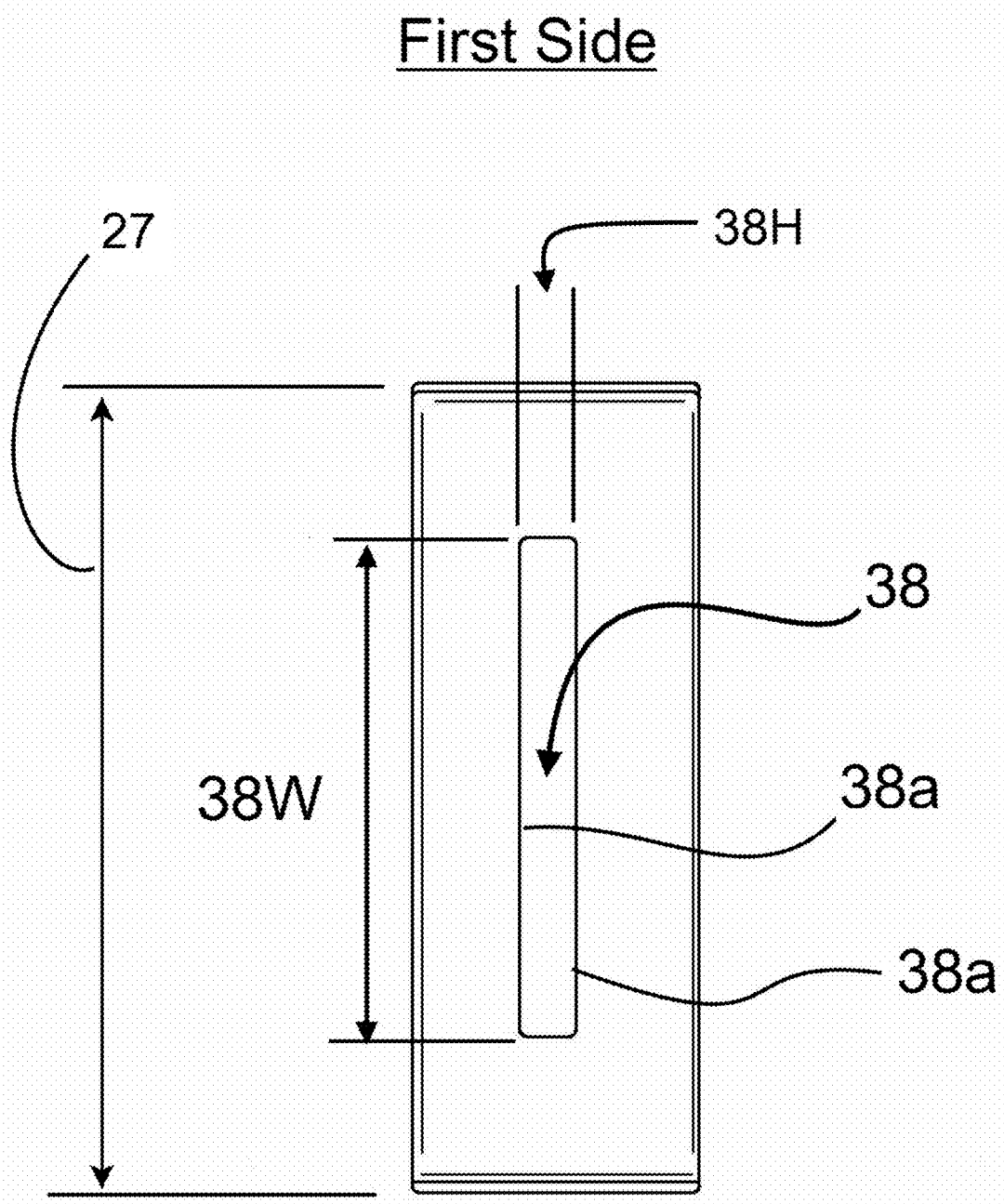
FIG. 4 is a first side elevational view of the strap wrench depicted in FIG. 1.

As best seen in FIG. 2 and FIG. 4, a first opening (38) is disposed along a first side of the body (10) between said first end (30) and said second end (32). For the current embodiment, body (10) defines cylinder that is at least partially hollow thereby defining an inner void (34). Similarly, the perimeter of the first opening (38) defines a rectangular slot in alignment with the cylindrical body (10) where the long sides (38*a*) have an equal length defining a first opening slot width (38W) and where the short sides have an equal length defining a first opening slot height (38H). The first opening (38) extends from the outer surface to the inner void (34).

Figure 5:
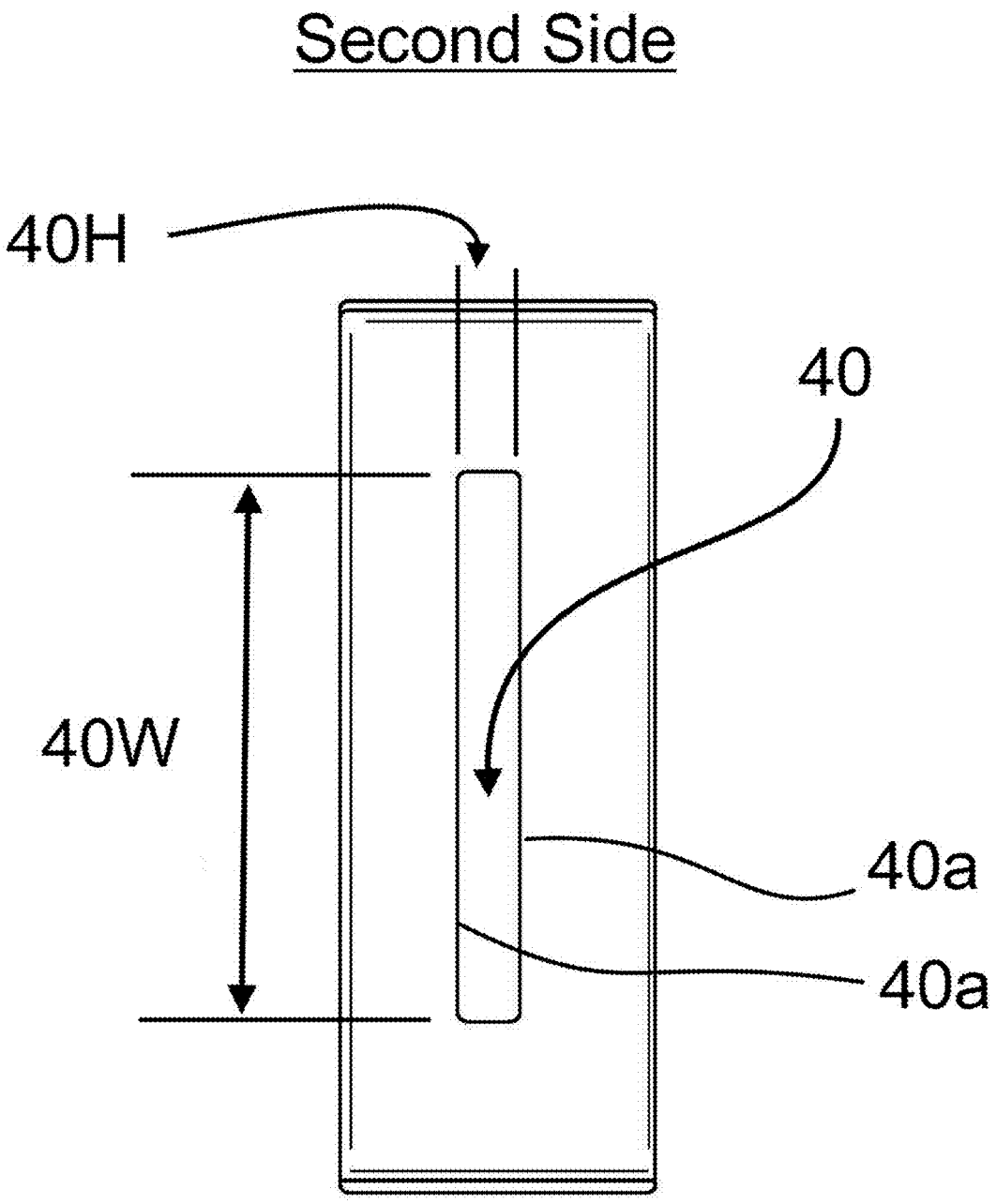
FIG. 5 is a second side elevational view of the strap wrench depicted in FIG. 1.
Figure 6:
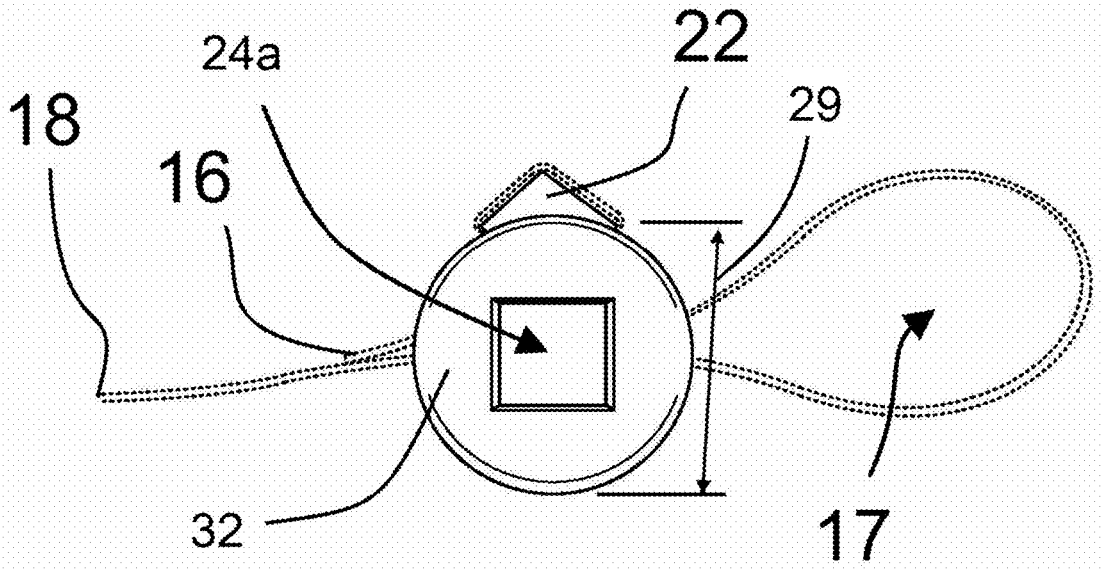
FIG. 6 is a first end elevational view of an assembled embodiment of an exemplary strap wrench.

As best seen in FIG. 5, the body (10) further defines a second opening (40) located between said first end (30) and said second end (32) disposed on the opposite side of the body (10) relative to said first opening (38). As with the first opening, the perimeter of the second opening (40) defines a rectangular slot in alignment with the cylindrical body (10) where the long sides (40*a*) have an equal length defining a second opening slot width (40W) and where the short sides have an equal length defining a second opening slot height (40H). For the currently preferred embodiment, the first opening (38) and the second opening (40) are disposed 180 degrees apart putting them in alignment on opposite sides of the body (10). The second opening (40) extends from the outer surface to the inner void (34) so that the first opening and the second opening define a passage through the body (10). Such passage allows a clasping element (14) to be inserted into and through the body (10) as previously described.

It will be appreciated that embodiments where the openings define sides of different lengths (e.g. perimeter defines a trapezoidal shape) fall within the scope and spirit of the invention. Additionally, a square body with square slot openings fall within the scope and spirt of the inventions. Also, opening perimeters that do not define a "slot", such as a circular hole, suitable for chains, ropes, cables, etc. fall within the scope and spirit of the invention.

Referring now to FIG. 1 and FIG. 2, the cradle portion (20) of body (10) is examined in more detail. The cradle portion (20) of body (10) defines a third opening (42) located between the first end (30) and the second end (32). The third opening (42) is disposed between said first opening (38) and said second opening (40). For the currently preferred embodiment, the third opening (42) is perpendicular to the passage defined by the first opening (38) and the second opening (40). It will be appreciated that configurations where the third opening (42) is not perpendicular as described above fall within the scope and spirit of the invention. The third opening (42) extends from the outer surface to the inner void (34) thereby defining an access to the passage through the body (10).

As with the first opening (30) and second opening (40), the perimeter of the third opening (42) defines a rectangular slot in alignment with the cylindrical body (10) where the long sides (42*a*) have an equal length defining a third opening slot width and the short sides have an equal length defining a third opening slot height.

Figure 7:
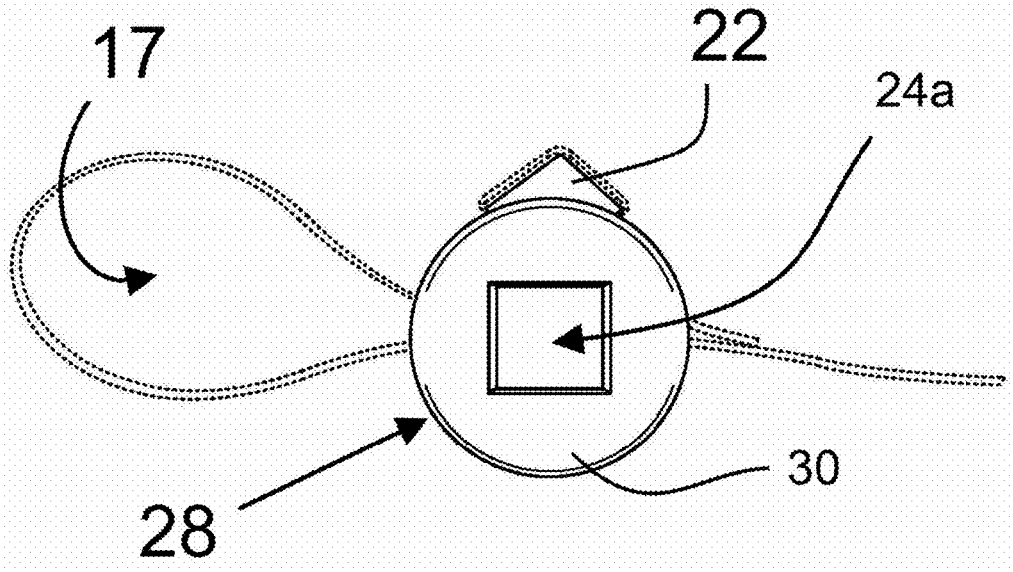
FIG. 7 is a second end elevational view of an assembled embodiment of an exemplary strap wrench.
Figure 8:
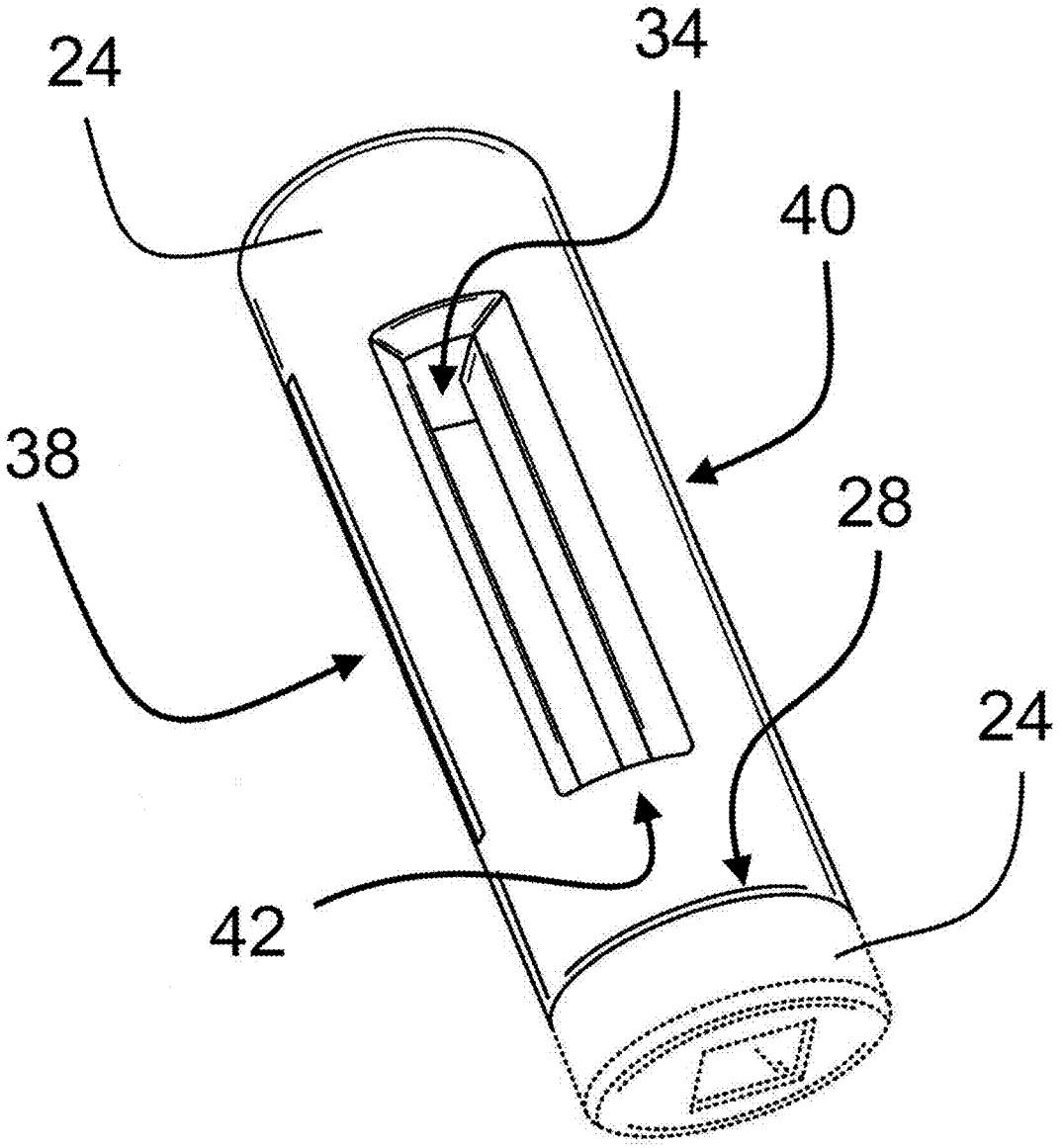
FIG. 8 is elevated perspective view of the strap wrench body depicted in FIG. 1 showing a third opening.

As best seen in FIG. 2 and FIG. 7, the cradle portion (20) is configured to receive a cradle element (22). For the preferred embodiment, the perimeter of the cradle element (22) defines a rectangular prism having a cradle element width (22*w*) that is slightly shorter than the third opening slot width. For better fitment or for a better association between cradle element (22) and the cradle portion (20), the long sides (42*a*) of the third opening (42) are beveled so that the cradle element (22) fits at least partially into the third opening (42) as depicted in FIG. 7 and FIG. 8. Notably, the perimeter of the cradle element (22) may define any suitable polygonal shape including a triangular shape defining a triangular prism.

The first opening, the second opening, and the third opening are configured and suitably sized to receive a clasping element as depicted in FIG. 1, FIG. 7 and FIG. 8. More particularly, where the clasping element is a strap defining a strap-thickness (52) and a strap-width (50) (FIG. 1), the first opening (38), the second opening (40), and said third opening (42) each define a slot with a slot-width that is longer than the strap-width (50) and wherein the slot height is at least two times the strap-thickness (52). That said, if one uses a clasping element that is compressible, then the slot heights can be less than twice the clasping element thickness.

Exemplary sizes where the body (10) defines a body length (27) of about 3.75 inches and wherein the outer perimeter (28) defines a circle having a diameter of about 1.25 inches. Thus, for the currently preferred embodiment, the body length is about 3 times the body diameter. Further, for the currently preferred embodiments, the slot-widths and slot-heights for all three openings are the same and are: slot-heights of about 5/16 inches and slot-widths of about 2.25 inches. Where the drive portion (24) defines a drive-void configured to receive the drive element (36) of a rotation-facilitator (26), the drive-void is suitably sized for such purpose. The cradle element width (22W) is about 2.15 inches which is slightly less than the slot-widths. The drive element height is about 5/16 inches. For such measurements, "about" means within plus/minus 10%.

For the embodiments described above, the body (10) is described as defining an internal void (34) with three openings providing access to such internal void (32). A different way to describe such an invention is to have only two "openings" although one opening goes all the way through body (10). For such a configuration, the body (10) defines an outer perimeter (28) thereby defining an outer surface. The body (10) further defines a first end (30) and an opposing second end (32) as before. Instead of describing an internal void (32), the body (10) is said to define a first opening defining a first slot disposed along a side the body (10) between said first end (30) and the second end (32) wherein such first slot extends through the body (10) thereby creating a passage through body (10). Such could be described as two opening, but here we are describing such configuration as defining one opening.

A cradle portion (20) defines a cradle slot (42) located between the first end (30) and the second end (32), wherein the cradle slot extends from said outer surface toward the center of the body (10) to the first slot thereby creating an access to the first slot passage. Preferably the cradle slot is perpendicular to said first slot. As before, the cradle portion (20) is configured to receive a cradle element (22).

The cradle element (22) is suitably sized and configured for being associated with said cradle slot where the outer perimeter of the cradle element defines any polygonal shape including rectangular and triangular prisms.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A core for receiving a clasping element suitable for clasping an object to be rotated, said core comprising:

an elongated body having an outer perimeter defining an outer surface, said elongated body further defining a first end and an opposing second end and further defining an inner void running at least partially between said first end and said second end;

a first opening disposed along the side of said elongated body between said first end and said second end, said first opening extending from said outer surface to said inner void;

a second opening located between said first end and said second end disposed on the opposite side of said elongated body relative to said first opening, said seconding opening extending from said outer surface to said inner void so that said first opening and said second opening define a passage through said elongated body;

a cradle portion defining a third opening located between said first end and said second end and disposed between said first opening and said second opening, said third opening extending from said outer surface to said inner void thereby defining an access to said passage;

wherein said cradle portion is configured to receive a cradle element and wherein said first opening, said second opening, and said third opening are configured for receiving a clasping element; and wherein at least one of said first end and said second end define a drive portion configured to facilitate rotation of said elongated body.

2. A core for receiving a clasping element as in claim 1, wherein said outer perimeter defines a circle and wherein said clasping element is a strap defining a strap-height and a strap-width and wherein said first opening, said second opening, and said third opening each define a slot wherein the length of each said slot is longer than said strap-width.

3. A core for receiving a clasping element as in claim 2, wherein said first opening and said second opening are in alignment relative to each other so that said passage extends straight through said body and wherein said third opening defines a path that is perpendicular to said passage.

4. A core for receiving a clasping element as in claim 3, wherein the long sides of the slot defined by the third opening are beveled.

5. A core for receiving a clasping element as in claim 4, wherein both the first end and said second end define a drive portion and wherein said drive portion comprises a drive-void configured for receiving the drive element of a tool that is one of a socket wrench and a power tool.

6. A core for receiving a clasping element as in claim 1, wherein said drive portion defines an integral rotation-facilitator configured for rotating said core in at least one of a polarity of directions.

7. A core for receiving a clasping element as in claim 1, wherein said clasping element is one of a strap, a chain, a rope, and a cable.

8. A core for receiving a clasping element as in claim 1, wherein both the first end and said second end define a drive portion and wherein said drive portion comprises a drive-void configured for receiving the drive element of a tool selected from the group of tools comprising a socket wrench, a speeder handle, a spanner wrench, a sliding T-handle, a hinge handle, a breaker bar, an Allen wrench and a power tool.

9. A core for receiving a clasping element as in claim 1, wherein said drive portion comprises a stud-extension configured for receiving the drive element of a tool selected from the group of tools comprising a socket, a wrench, a ratcheting box wrench, an adjustable wrench, and a power tool.

10. A tool defining an adjustable clasping element suitable for clasping an object to be rotated for a plurality of object sizes, said tool comprising:

a body having an outer perimeter defining an outer surface, said body further defining a first end and an opposing second end and further defining an inner void running at least partially between said first end and said second end;

a first opening disposed along the side of said body between said first end and said second end, said first opening extending from said outer surface to said inner void;

a second opening located between said first end and said second end disposed on the opposite side of said body relative to said first opening, said seconding opening extending from said outer surface to said inner void so that said first opening and said second opening define a passage through said body;

a cradle portion defining a third opening located between said first end and said second end and disposed between said first opening and said second opening, said third opening extending from said outer surface to said inner void thereby defining an access to said passage;

wherein said cradle portion is configured to receive a cradle element and wherein said first opening, said second opening, and said third opening are configured for receiving a clasping element;

a cradle element configured for being associated with said cradle portion;

a clasping element defining a first-clasping-element-end and an opposing second-clasping-element-end, said first-clasping-element-end configured to pass into said first opening, through said passage and out said second opening, create a loop and pass back into said second opening and then pass through said third open and wraparound said cradle element and pass back through said third opening to said passage and back out said first opening; and wherein at least one of said first end and said second end define a drive portion configured to facilitate rotation of said body.

11. A tool defining an adjustable clasping element as in claim 10, wherein said clasping element is a strap and wherein said first opening, said second opening, and said third opening each define a slot where the length of each said slot is longer than the width of said strap.

12. A tool defining an adjustable clasping element as in claim 11, wherein the first opening and second opening are in alignment relative to each other so that said passage extends straight through said body and wherein said third opening is perpendicular to said passage.

13. A tool defining an adjustable clasping element as in claim 11, wherein the long sides of the slot opening defined by said cradle are beveled.

14. A tool defining an adjustable clasping element as in claim 13, where said cradle element is one of a rectangular prism and a triangular prism and wherein the outer perimeter of said body defines a circle.

15. A tool defining an adjustable clasping element as in claim 14, wherein both said first end and said second end define a drive portion and wherein said drive portion comprises a drive-void configured for receiving the drive element of a tool selected from the group of tools comprising a socket wrench, a speeder handle, a spanner wrench, a sliding T-handle, a hinge handle, a breaker bar, an Allen wrench and a power tool.

16. A tool defining an adjustable clasping element as in claim 14, wherein said drive portion comprises a stud-extension configured for receiving the drive element of a tool selected from the group of tools comprising a socket, a wrench, a ratcheting box wrench, an adjustable wrench, and a power tool.

17. A tool defining an adjustable clasping element as in claim 10, wherein said drive portion defines an integral rotation-facilitator configured for rotating said body in at least two of a polarity of directions.

18. A strap wrench defining an adjustable strap element suitable for clasping an object to be rotated for a plurality of object sizes, said strap wrench comprising:

a body defining an outer perimeter defining an outer surface, said body further defining a first end and an opposing second end;

a first opening defining a first slot disposed along a side of said body between said first end and said second end wherein said first slot extends through said body thereby creating a passage through said body;

a cradle portion defining a cradle slot located between said first end and said second end, wherein said cradle slot extends from said outer surface toward the center of said body to passage thereby creating an access to said passage, and wherein said cradle slot defines a path that is perpendicular to said passage and wherein said cradle portion is configured to receive a cradle element;

a cradle element configured for being associated with said cradle slot;

a strap element defining a strap-width and a strap-thickness;

wherein the length of each of said first slot and said cradle slot are longer than said strap-width and the height of each of said first slot and said cradle slot are longer than at least twice said strap-thickness; and wherein at least one of said first end and said second end define a drive portion configured to facilitate rotation of said elongated body.

19. A strap wrench defining an adjustable strap element as in claim 18, wherein the long sides of said cradle slot are beveled and wherein said cradle element is one of a rectangular prism and a triangular prism defining a length shorter than said cradle slot length and wherein the outer perimeter of said body defines a circle.

20. A strap wrench defining an adjustable strap element as in claim 19, wherein both said first end and said second end each define a drive portion and wherein said drive portion is one of (a) a drive-void configured for receiving the drive element of a tool selected from the group of tools comprising a socket wrench, a speeder handle, a spanner wrench, a sliding T-handle, a hinge handle, a breaker bar, an Allen wrench and a power tool, (b) a stud-extension configured for receiving the drive element of a tool selected from the group of tools comprising a socket, a wrench, a ratcheting box wrench, an adjustable wrench, and a power tool, and (c) an integral rotation-facilitator configured for rotating said elongated body in at least one of a plurality of directions.

* * * * *